United States Patent [19]

Stout

[11] Patent Number: 4,927,009

[45] Date of Patent: May 22, 1990

[54] ARTICLE CARRIER

[75] Inventor: James T. Stout, Ellijay, Ga.

[73] Assignee: The Mead Corporation, Dayton, Ohio

[21] Appl. No.: 343,968

[22] Filed: Apr. 27, 1989

[51] Int. Cl.[5] ..... B65D 85/40

[52] U.S. Cl. ..... 206/188; 206/187; 206/161; 206/175; 206/180; 206/173

[58] Field of Search ..... 206/161, 175, 180, 182, 206/183, 186, 188, 427, 171, 172, 173, 187; 229/52 BC

[56] References Cited

U.S. PATENT DOCUMENTS

| | | | |
|---|---|---|---|
| 2,835,408 | 5/1958 | Arneson | 229/52 BC |
| 3,456,841 | 7/1969 | Mahon et al. | 206/187 |
| 3,572,544 | 3/1971 | Forrer | 229/52 BC |
| 3,661,297 | 5/1972 | Wood | 206/187 |
| 3,709,400 | 1/1973 | Arneson | 229/52 BC |
| 3,739,940 | 6/1973 | Harrelson | 206/173 |
| 3,857,483 | 12/1974 | Wood | 206/188 |
| 4,117,925 | 10/1978 | Wood | 206/186 |
| 4,153,158 | 5/1979 | Graser et al. | 206/187 |
| 4,217,983 | 8/1980 | Stout | 206/188 |
| 4,253,564 | 3/1981 | Engdahl, Jr. | 206/187 |
| 4,722,437 | 2/1988 | Walsh | 206/175 |

*Primary Examiner*—David T. Fidei
*Attorney, Agent, or Firm*—Thomas A. Boshinski

[57] ABSTRACT

The article carrier for bottles and the like includes a bottom wall, opposed side walls joined to the bottom wall along opposite side edges thereof, and end wall panels joined respectively to the end edges of the side walls and extending inwardly of the carrier. A first pair of riser panels is foldably joined respectively to the end wall panels at one end of the carrier, is foldably joined to each other along a riser fold line, and extends medially inward of the carrier. A second pair of riser panels is foldably joined respectively to the opposite end wall panels and extends medially inward of the carrier. A pair of handle panels is foldably joined respectively to the first pair of riser panels and is foldably joined to each other along a handle fold line. The first pair of riser panels is provided with a plurality of elongated openings which lie with their axes of elongation along the riser fold line so as to extend into each of the first pair of riser panels. At least one of the elongated openings has its side edges extending inwardly from each end of the opening to lie along the riser fold line. The side edges of the one elongated opening cooperate with the handle fold line during folding to force the panels to fold in the proper alignment.

3 Claims, 4 Drawing Sheets

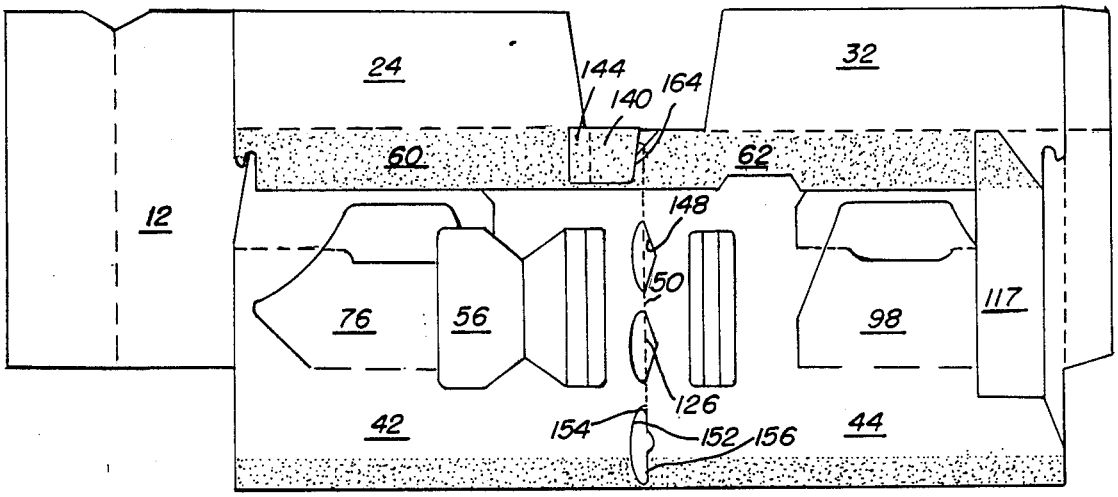
FIG. 4
FIG. 5
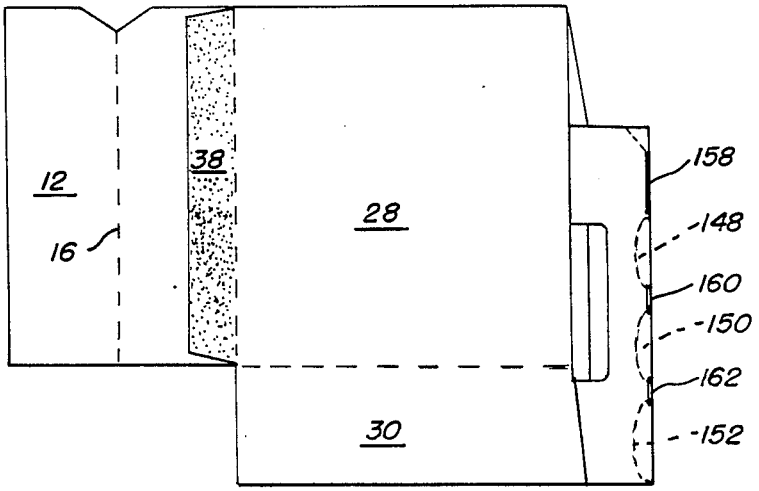
FIG. 6
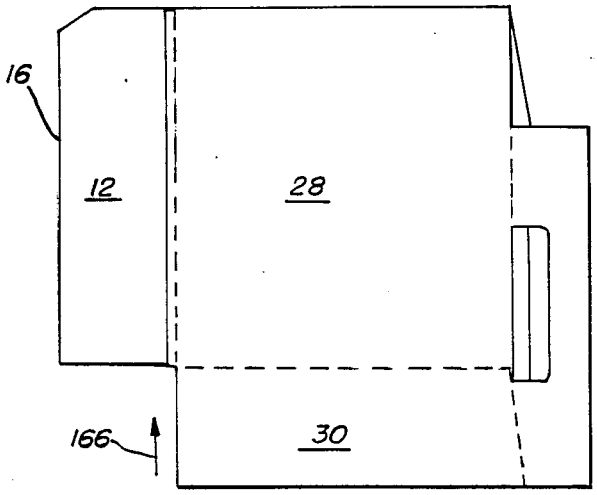

ARTICLE CARRIER

BACKGROUND OF THE INVENTION

The present invention relates generally to the packaging of fragile articles such as soft drink and beer bottles, and more particularly to the packaging of such articles in a carrier having an open top and upstanding handle. Such carriers are frequently referred to as basket carriers.

Article carriers of this type are disclosed, for example, in U.S. Pat. Nos. 3,661,297; 3,349,957; and 4,217,983. Such carriers, as shown in these patents, typically include bottom, side and end walls. A pair of medial partition or riser panels extends upwardly through the carrier, dividing into two rows the bottles placed within the carrier. Typically, a pair of handle panels is foldably connected to the riser panels and, as the carrier is assembled, is folded onto the riser panels in an overlying relationship. Such panels serve to reinforce the handle region of the carrier and provide greater comfort when carrying.

The riser panels and handle panels are each joined along a respective fold line which in the finished carrier is located at the uppermost portion of the carrier. It is important that these folds be accurately made during the assembly procedure, because any misalignment will remain in the assembled carrier since the panels are secured in position by gluing. Inaccurate folding along these fold lines can result in a skewed condition to the carrier, thereby diminishing its strength and stability. Further, such condition increases the likelihood of the carrier being caught or damaged as it moves through the remainder of the assembly machinery and through subsequent set-up, loading and other operations.

SUMMARY OF THE INVENTION

Accordingly, the present invention provides an article carrier having means for ensuring that the folds between the riser panels and handle panels are accurately made. The article carrier of the invention includes a bottom wall, opposed side walls joined to the bottom wall along opposite side edges thereof, and end wall panels joined respectively to the end edges of the side walls and extending inwardly of the carrier. A first pair of riser panels is foldably joined respectively to the end wall panels at one end of the carrier, is foldably joined to each other along a riser fold line, and extend medially inward of the carrier. A second pair of riser panels is foldably joined respectively to the opposite end wall panels and extend medially inward of the carrier. A pair of handle panels is foldably joined respectively to the first pair of riser panels and is foldably joined to each other along a handle fold line.

The first pair of riser panels is provided with a plurality of elongated openings which lie with their axis of elongation along the riser fold line so as to extend into each of the first pair of riser panels. As a result, segments of the riser fold line are defined along the line, the segments being separated by the openings. However, at least one of the elongated openings has its side edges extending inwardly from each end of the opening to lie along the riser fold line. As the carrier is assembled, the handle panels are folded onto the riser panels, such that the handle fold line overlies the riser fold line. The side edges of the one elongated opening cooperate with the handle fold line to force the panels to fold in the proper alignment.

A plurality of slits may be located along the handle fold line. These slits are of a length and arranged to overlie the segments of the riser fold line upon folding of the handle panels onto the riser panels. This further permits accurate folding of these panels by enabling the segments of the riser fold line to fit snugly within the handle fold line.

BRIEF DESCRIPTION OF THE DRAWINGS

FIGS. 2, 3, 4, 5 and 6 depict intermediate stages through which the blank of FIG. 1 is manipulated and glued in order to form a complete and collapsed carrier;

DETAILED DESCRIPTION OF THE PREFERRED EMBODIMENT

Figure 1:
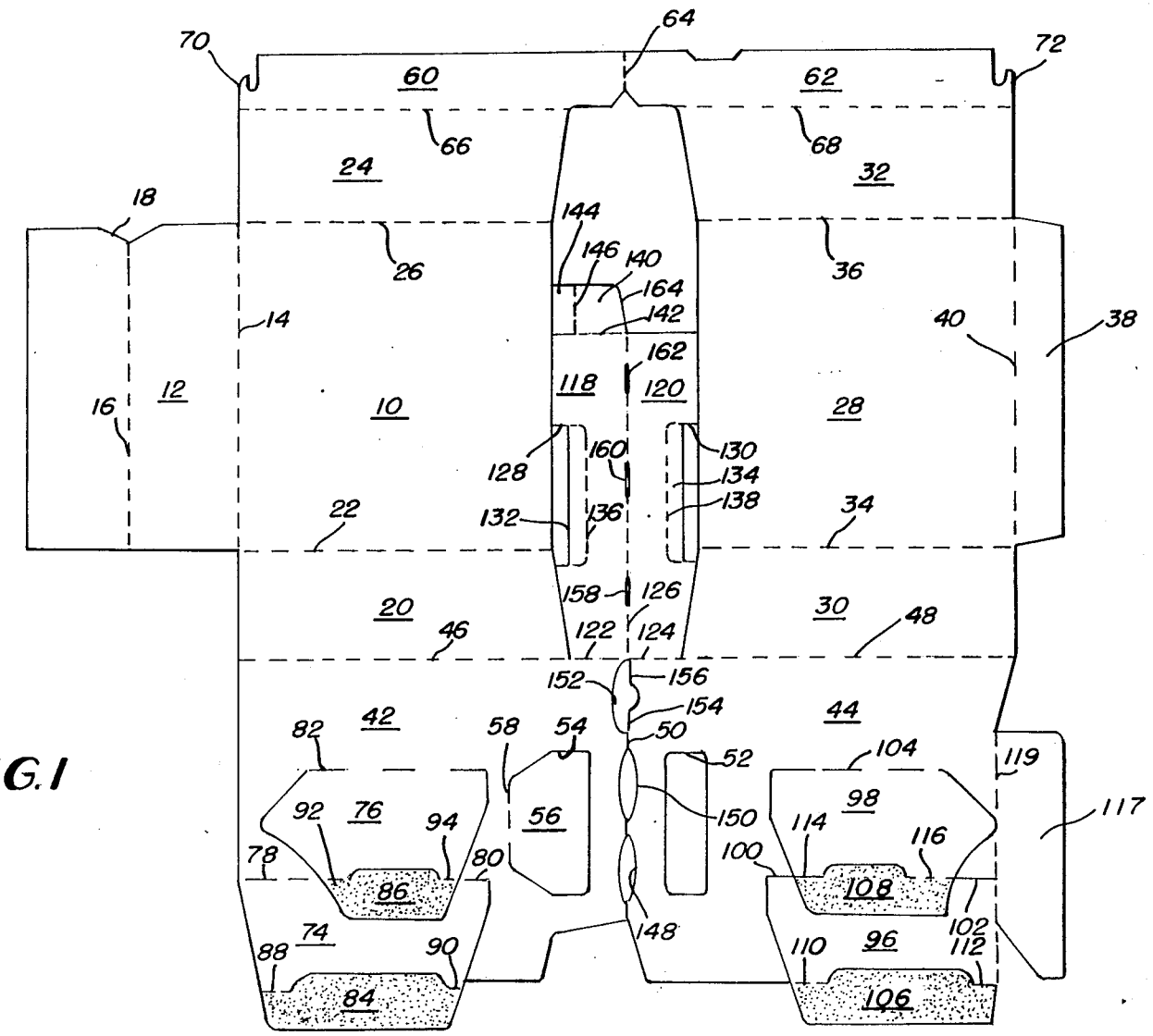
FIG. 1 is a plan view of the blank from which the carrier according to the present invention is formed.

Referring now generally to FIG. 1, a blank is shown from which the article carrier of the present invention may be formed. A side wall 10 of the carrier has connected to the bottom edge thereof a bottom panel 12 which is foldably joined along fold line 14. Bottom 12 is provided with a medial fold line 16 and a notch 18. End wall panel 20 is foldably joined to an end edge of side wall 10 along fold line 22 and, similarly, end wall panel 24 is foldably joined to the opposite edge of side wall 10 along fold line 26. The opposite side of the blank is similarly formed to that just described and includes side wall 28 to the ends of which end wall panels 30 and 32 are foldably joined respectively along fold lines 34 and 36. In addition, connected to the bottom of side wall 28 is a glue flap 38 connected along fold line 40.

The medial structure for the carrier is formed in part by means of a first pair of medial partition or riser panels 42 and 44. Specifically, medial partition panel 42 is foldably joined to end wall panel 20 along fold line 46 and medial partition panel 44 is foldably joined to end wall panel 30 along fold line 48. Medial partition panels 42 and 44 are themselves connected along a medial fold line 50. In addition, medial partition panel 44 is provided with hand gripping aperture 52, while medial partition panel 42 is provided with hand gripping aperture 54, this latter aperture being closed by panel 56 connected to the medial partition panel 42 along fold line 58. The medial structure at the other end of the blank is formed by means of a second pair of riser panels 60 and 62 which are joined at fold line 64. Also, riser panels 60 and 62 are foldably joined respectively to end wall panels 24 and 32 along fold lines 66 and 68 and are provided with locking notches 70 and 72.

The transverse partition structure on one side of the carrier is formed by transverse partition panels 74 and 76. Specifically, transverse partition panel 74 is foldably joined to medial partition panel 42 along fold lines 78 and 80, while transverse partition panel 76 is foldably joined to medial partition panel 42 along fold line 82. In order to provide means for securing the transverse partition panels to the associated side walls, anchoring tabs 84 and 86 are foldably joined to transverse partition panels 74 and 76 along fold lines 88 and 90, and 92 and 94, respectively.

The transverse partition structure for the other side of the carrier is similar to that just described and includes transverse partition panels 96 and 98. Transverse partition panel 96 is foldably joined to medial partition panel 44 along fold lines 100 and 102 and transverse partition panel 98 is foldably joined to medial partition panel 44 along fold line 104. Anchoring tabs 106 and 108 are foldably joined respectively to transverse partition panels 96 and 98 along fold lines 110 and 112, and 114 and 116. A medial anchoring panel 117 is connected to the bottom end of medial panel 44 along fold line 119.

In addition to hand gripping apertures 52 and 54, handle structure for the carrier is provided in the form of handle panels 118 and 120. Specifically, handle panels 118 and 120 are foldably joined respectively to medial partition panels 42 and 44 along fold lines 122 and 124 and, additionally, are foldably joined to each other along handle foldline 126. To provide means for carrying the carrier, hand gripping apertures 128 and 130 are formed respectively in handle panels 118 and 120. In addition, hand gripping apertures 128 and 130 are provided respectively with hand cushioning flaps 132 and 134 which are foldably joined respectively to handle panels 118 and 120 along fold lines 136 and 138.

A locking flap 140 is provided, foldably joined to handle panel 118 along fold line 142. A locking tab 144 is connected along one edge to locking flap 140, connected alOng fold line 146.

Positioned along riser fold line 50 is a plurality of elongated openings 148, 150 and 152. The openings are oriented to lie along fold line 50 with their axis of elongation along the fold line, whereby the openings 148, 150 and 152 extend slightly into each of the medial partition panels 42 and 44. One of the elongated openings 152 includes side edges 154 and 156 which extend inwardly from each end of opening 152 so as to lie along the riser fold line 50.

Defined along handle fold line 126 is a plurality of slits 158, 160 and 162. The function of the openings and slits will be described in detail in connection with the assembly of the blank into a completed carrier.

To form the completed carrier from the blank shown in FIG. 1, initially an application of glue is made to anchoring tabs 84, 86, 106 and 108, as shown by stippling in FIG. 1. Following this, medial panels 42 and 44 and the associated transverse partition structure in the form of transverse partition panels 74, 76, 96 and 98 as well as anchoring tabs 84, 86, 106, and 108 are all elevated and folded over along fold lines 46, 48, 122 and 124. By this operation, anchoring tabs 84 and 86 are adhered to the inner surface of side wall 10 and, similarly, anchoring tabs 106 and 108 are adhered to the inner surface of side wall 28. The results of this folding are shown in FIG. 2.

Figure 2:
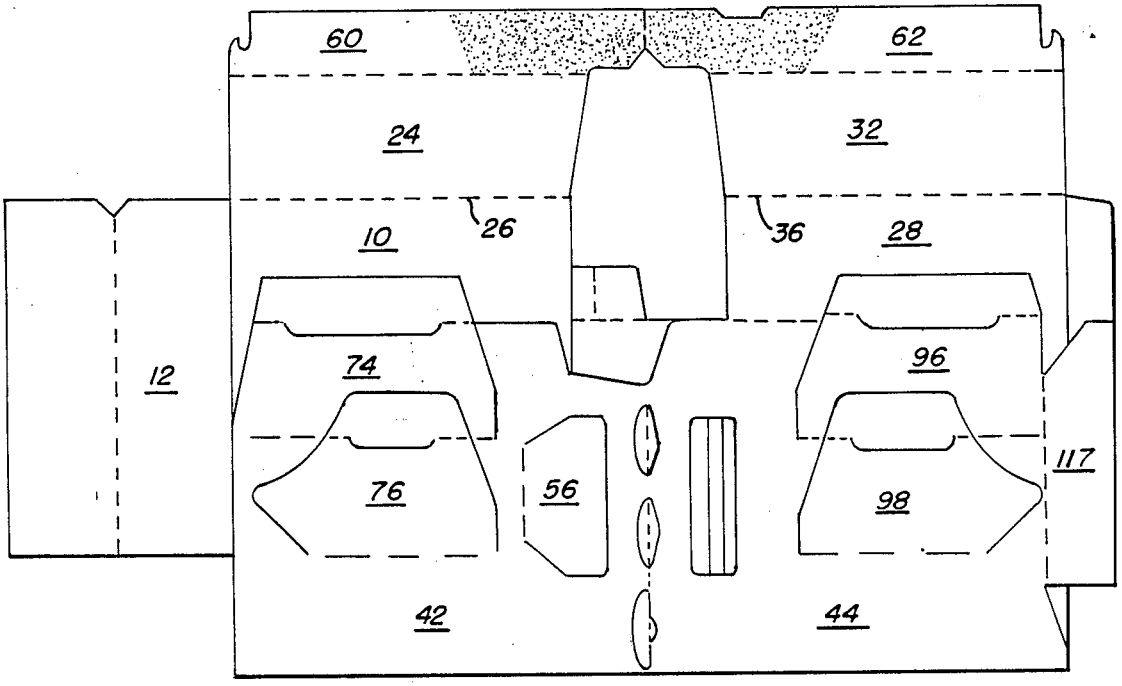
Figure 3:
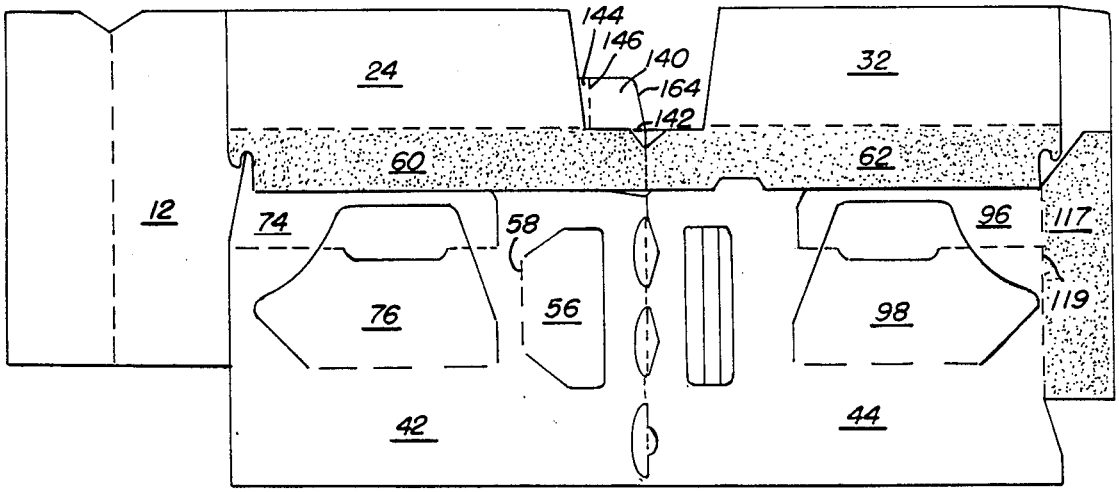

Following this operation, glue is applied to portions of riser panels 60 and 62 as shown by stippling in FIG. 2, and then end wall panels 24 and 32 together with riser panels 60 and 62 are elevated and folded over along fold lines 26 and 36 to occupy the positions shown in FIG. 3. Glue causes riser panels 60 and 62 to adhere to medial partition panels 42 and 44.

Next, as shown in FIG. 3, glue is applied to riser panels 6 and 62 and to medial anchoring panel 117. Locking panel 140 is folded onto riser panel 60 along fold line 142. Fold line 146 connecting locking tab 144 to locking panel 140 enables locking tab 144 to clear end wall 24. Locking panel 140 is then secured by the glue to riser panel 60. Medial anchoring panel 117 is folded along fold line 119 onto medial partition panel 44 and riser panel 62. As can be seen in FIG. 3, glue is applied as shown to avoid any gluing between medial anchoring panel 117 and transverse partition panels 96 and 98. Finally, aperture panel 56 is folded along fold line 58 so as to lie in contact with transverse partition panel 76 and medial partition panel 42. Glue need not be applied to panel 56, although gluing can be performed if desired. Upon completion of this operation, the blank appears as shown in FIG. 4.

In the next operation, glue is applied along medial partition panels 42 and 44 and medial anchoring panel 117, locking panel 140 and locking tab 144 as shown by stippling in FIG. 4 (glue already having been applied to riser panels 60 and 62). The two halves of the carrier are then folded along medial fold line 50 and handle fold line 126 to locate the two halves in overlying relationship.

Figure 7:
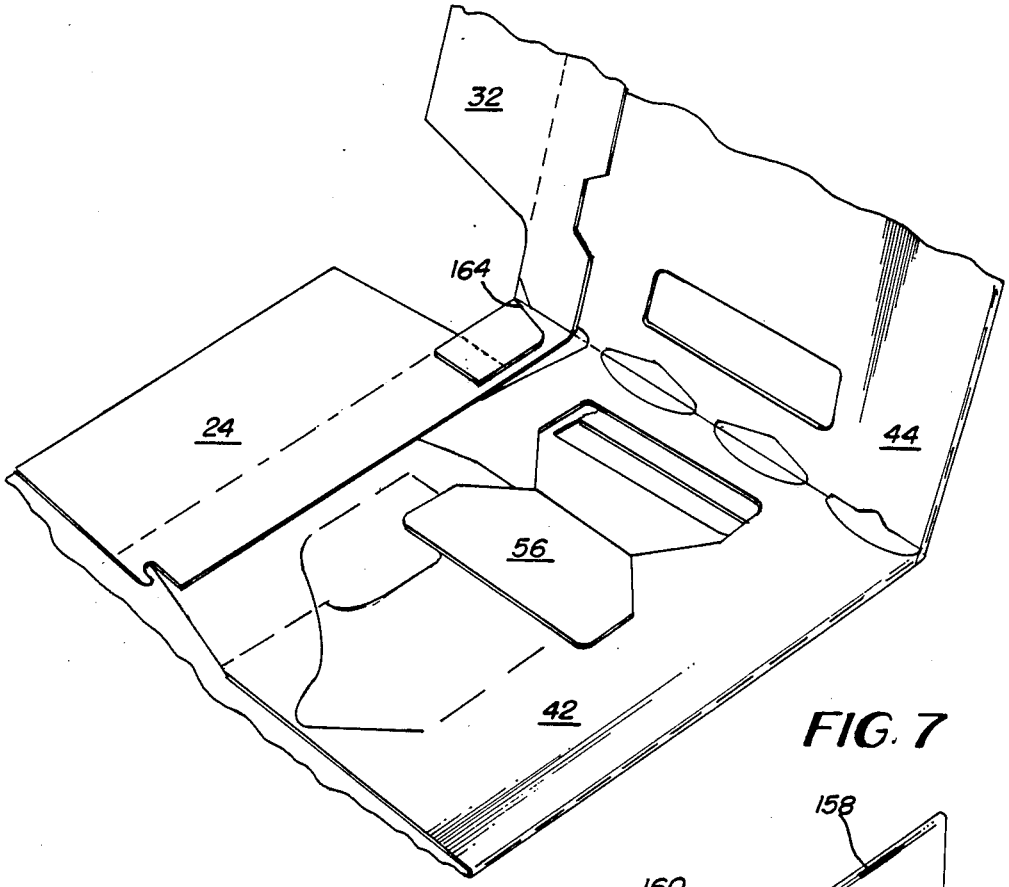
FIG. 7 is a fragmentary view of the handle and riser panels during the folding of such panels, showing the inner side of the fold.

The folding of the halves of the carrier can be seen in greater detail by reference to FIG. 7. It should be noted therefrom that folding occurs along openings 148, 150 and 152. Particularly, edges 154 and 156 of opening 152, which lie along fold line 50, engage the underlying fold line 126 and serve to force the halves of the carrier into proper orientation with respect to each other. It will also be noted that edge 164 of locking panel 140 further serves to direct the folded halves into the proper orientation. Upon completion of folding, the almost completed carrier appears as shown in FIG. 5.

The purpose of slits 158, 160 and 162 can be seen by reference to FIG. 5. Comparing FIGS. 4 and 5, the positioning of openings 148, 150 and 152 along fold line 50 effectively causes fold line 50 to exist as a plurality of segments. Upon completion of the folding operation, the segments of medial fold line 50 will align with slits 158, 160 and 162, and indeed, will extend slightly into these slits. As a result, fold lines 50 and 126 may more properly align and cooperate with each other as folding of the two halves of the carrier is preformed. Thus, the upper edges of medial partition panels 42 and 44 will remain closely fitting within handle fold line 126, and further misorientation of the carrier halves by attempting to fold along a double thickness of material can be avoided. Also, edges 154 and 156 fit more deeply into the handle fold line 126.

Figure 8:
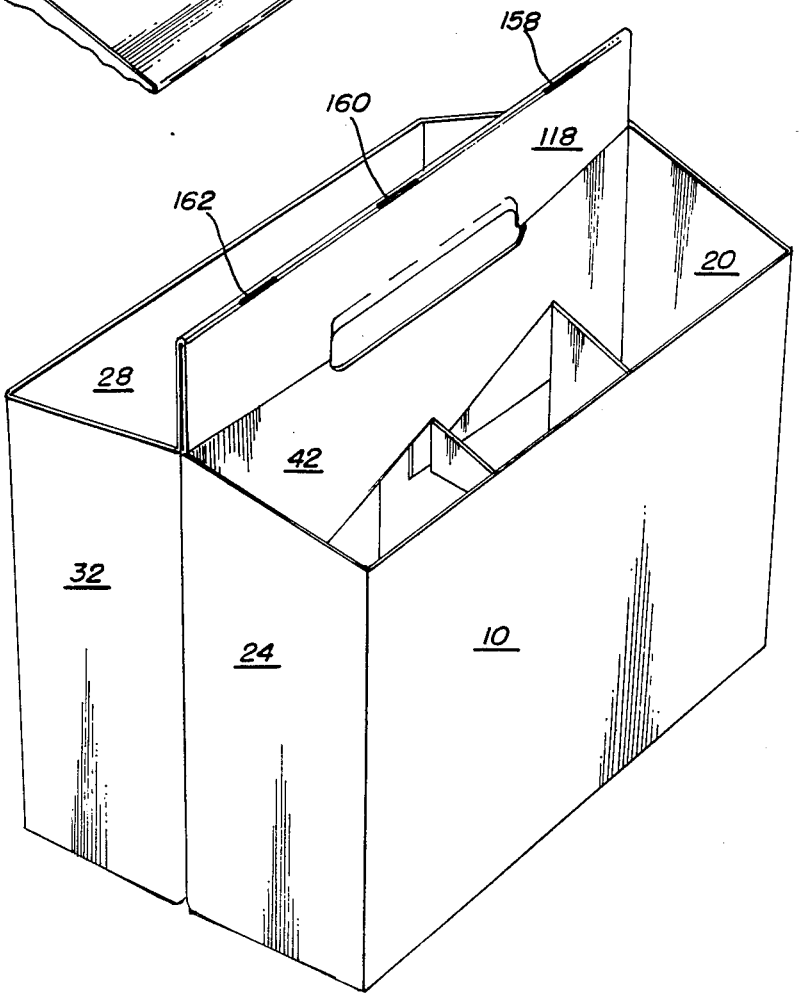
FIG. 8 is an isometric view of the set-up carrier.

To complete the carrier, glue is applied to glue flap 38 as indicated by stippling in FIG. 5. Bottom wall 12 is thereafter folded along medial fold line 16, whereby glue flap 38 is adhered to bottom panel 12. The carrier then appears as shown in FIG. 6. In order to set up the carrier from its collapsed condition as shown in FIG. 6 into the condition shown in FIG. 8, it is simply necessary to secure side walls 10 and 28 against movement and to apply force in the direction shown by arrow 166 to the medial edges of end wall panels 20 and 30. The expands the carrier and moves the side walls apart. Simultaneously, the bottom 12 is folded into a flat plane. The carrier is then maintained in set up condition, as shown in FIG. 8, by cooperation between the locking notches 70 and 72 and notch 18 of bottom panel 12.

It should be recognized that the exact combination of openings and slits in medial partition panels 42 and 44 and handle panels 118 and 120 as shown in this embodiment is not required for the practice of the invention. To a large extent, the number of such openings and slits will be determined by the size of the carrier. Indeed, in the case of relatively long carriers designed to hold eight, ten or more bottles, it may be desirable to include two openings similar to opening 152 at opposite ends of medial partition panels 42 and 44, each having side edges located along the medial fold line. Of course, it will be seen that the greater the length of the carrier, the more difficult and critical that proper skew alignment of the halves of the carrier be maintained during the folding operation.

It should be also be noted that although the riser panels 60 and 62 are shown in a narrow configuration, this invention is not so limited as the riser panels could be substantially wider than shown in the drawings without deviating from the scope of the invention. Also, medial partition panels 42 and 44 at the other end of the carrier could be replaced by riser panels similar to panels 60 and 62 if other carrier partition means, such as transverse straps or glued in partition inserts, as is known in the art, is used.

While the carrier described herein constitutes a preferred embodiment of this invention, it is to be understood that the invention is not limited to this precise embodiment and that changes may be made therein without departing from the scope of the invention, which is defined in the appended claims.

What is claimed is:

1. An article carrier comprising:

a bottom wall;

opposed side walls joined to said bottom wall along opposite side edges thereof;

end wall panels joined respectively to the end edges of said side walls and extending inwardly of the carrier;

a first pair of riser panels foldably joined respectively to said end wall panels at one end of the carrier, foldably joined to each other along a riser fold line, and extending medially inward of the carrier;

a second pair of riser panels foldably joined respectively to said end wall panels and extending medially inward of the carrier;

a pair of handle panels foldably joined respectively to said first pair of riser panels, and foldably joined to each other along a handle fold line;

said first pair of riser panels having a plurality of elongated openings defined therethrough and lying with their axis of elongation along said riser fold line to extend into each of said first pair of riser panels, and thereby to define segments of said riser fold line separated by said openings;

at least one of said elongated openings having side edges extending inwardly from each end of said one opening to lie along said riser fold line.

2. The article carrier of claim 1, wherein said pair of handle panels define along said handle fold line a plurality of slits, said slits being of a length and arranged to overlie said segments of said riser fold line upon folding of said handle panels onto said riser panels.

3. The article carrier of claim 1, wherein said first pair of riser panels are extended to form medial partition panels and a pair of transverse partition panels is foldably joined respectively to said side walls.

* * * * *